US005085040A

United States Patent [19]

Tilston

[11] Patent Number: 5,085,040

[45] Date of Patent: Feb. 4, 1992

[54] TORCH IGNITERS

[75] Inventor: John R. Tilston, Farnham, England

[73] Assignee: The Secretary of State for Defence in Her Britannic Majesty's Government of the United Kingdom of Great Britain and Northern Ireland, London, England

[21] Appl. No.: 469,485

[22] PCT Filed: Oct. 13, 1988

[86] PCT No.: PCT/GB88/00826

§ 371 Date: Apr. 11, 1990

§ 102(e) Date: Apr. 11, 1990

[87] PCT Pub. No.: WO89/03960

PCT Pub. Date: May 5, 1989

[30] Foreign Application Priority Data

Oct. 19, 1987 [GB] United Kingdom ..... 8724455

[51] Int. Cl.[5] ..... F02C 7/266

[52] U.S. Cl. ..... 60/39.827; 431/266; 431/265

[58] Field of Search ..... 431/263, 264, 265, 266; 60/39.06, 39.826, 39.827, 748

[56] References Cited

U.S. PATENT DOCUMENTS

| | | | |
|---|---|---|---|
| 3,057,159 | 10/1962 | Benedict | 60/39.82 |
| 3,361,185 | 1/1968 | Anderson et al. | 431/266 X |
| 3,487,636 | 1/1970 | Vdoviak et al. | 60/39.82 |
| 3,892,206 | 7/1975 | Kobayashi | 431/266 X |
| 4,023,351 | 5/1977 | Beyler et al. | 431/265 X |
| 4,215,979 | 8/1980 | Morishita | 431/264 |
| 4,547,147 | 10/1985 | Suzuki et al. | 431/265 |

FOREIGN PATENT DOCUMENTS

| | | | |
|---|---|---|---|
| 1096684 | 1/1961 | Fed. Rep. of Germany | 60/39.826 |
| 430043 | 2/1948 | Italy | 431/263 |
| 2993552A | 3/1979 | United Kingdom . | |

*Primary Examiner*—Carl D. Price
*Attorney, Agent, or Firm*—Nixon & Vanderhye

[57] ABSTRACT

A torch igniter intended particularly for gas turbine engine applications comprises an integral assembly of a flame lighter and a fuel atomizer of the pre-filming air blast type. The fuel atomizer is configured so as to encircle the tip of the flame lighter and this atomizer comprises fuel and air inlets, a fuel/air passage defined between a body portion of the flame lighter and a sleeve this fuel air passage extending from the inlets to an exit mouth around the electrodes at the tip of the flame lighter, and an atomizer lip at the mouth of the fuel/air passage. A secondary passage can be included to aid in atomization of the fuel and in direction of the spray of atomized fuel this secondary passage having an exit annulus encircling the mouth of the fuel/air passage. A further passage can be included which is exposed to heat exchange with exterior air to pre-cool compressor delivery air before supply to the atomizer. This torch igniter is intended to be resistant to sprayer blockage and therefore suitable for use in a mode in which the fuel supply to the atomizer is cut off once the main burner is lighted.

9 Claims, 2 Drawing Sheets

1
3
4
7
8
11
12
13
16
17
19
20
24
30
31
32
33
34

TORCH IGNITERS

BACKGROUND OF THE INVENTION

1. Field of the Invention

This invention relates to ignition devices of the form which are known, in the context of aero gas turbine engines at least, as torch igniters. The torch igniter which constitutes the present invention is particularly intended for use in a gas turbine engine such as an aero engine or a marine engine but it could possibly find use in other additional applications such as boilers or furnaces.

2. Discussion of Prior Art

Gas turbine engine igniters are of two separate types. Both utilize what is termed herein a "flame lighter" that is a device such as a spark or surface discharge unit for supplying the heat to initiate combustion. In the first type of igniter the flame lighter is situated within the combustion chamber such that it is within the influence of the main fuel spray. The second type of igniter is the torch igniter with which this invention is concerned and this igniter form comprises a flame lighter co-located with a fuel atomizer or sprayer which is auxillary to the main sprayer. This type of igniter is well established in the art being utilized particularly in vapourizing combustors which rely on the heat of combustion to evaporate the fuel of the main supply thus necessitating an independent source of suitably atomised fuel for ignition purposes.

Torch igniters are less sensitive to location within the combustion chamber than are igniters reliant on fuel from the main sprayer and accordingly they can often be positioned such that they are not exposed to the most extreme conditions present within the combustion chamber. Such siting of the torch igniter may avoid the worst of the damage phenomena to which the other igniters are subjected. However the conventional torch igniter which utilizes a fuel injector, such as a swirl atomizer or fan sprayer, mounted alongside the flame lighter is very susceptable to blockage of the injector because it has a fine exit hole or passage at the tip adjacent the flame which is easily obstructed and because at high engine power the fuel within the atomizer is exposed to temperatures at which the fuel can 'crack' to produce gums or coke. It is conventional to maintain the fuel flow through the torch igniter fuel injector in order to cool the injector and thus minimise risk of blockage but this produces secondary problems. The burning fuel from the torch igniter, during normal running of the engine, may generate 'hot streaks' in the gases within the combustion chamber which are close to the combustion chamber walls and the flame lighter and which cause problems for wall cooling and lighter life. Soot or coke from the burning fuel may degrade the operation of the flame lighter by formation of deposits on or near the flame lighter surface.

The torch igniter is only required to function during the start-up phase of engine operation and in any altitude relight which might be required. The fuel supply to the torch igniter could therefore be shut off during normal running of the engine with benefits to the efficiency of the engine and the life expectancy of parts of it providing the problems of blockage in the torch fuel injector could be solved.

It has previously been proposed to do this by utilizing purge air in connection with a conventional torch igniter. This is not attractive at least in aero engines because a separate supply of 'bottled' purge air is required in order to supply the necessary purging pressure, and the additional equipment weight and operational complexity outweigh the benefit achieved.

SUMMARY OF THE INVENTION

The present invention is a torch igniter of novel form which is particularly suited to operation in a manner such that the fuel supply to the torch igniter fuel injector may be discontinued once the engine is started with minimal risk of blockage to the injector and without resource to a separate supply of high pressure purging air.

This invention is a torch igniter comprising a flame lighter having an operative tip section and an elongate body, a sleeve present around the body of the flame lighter and spaced therefrom so as to define therebetween a passage the sleeve being configured such that said passage, hereinafter identified as the fuel/air passage, opens at a mouth portion around the tip of the flame lighter, at least one air inlet which discharges into the fuel/air passage at a position therein spaced from the passage mouth, at least one fuel inlet which discharges into the fuel/air passage at a position therein which is spaced from the passage mouth but is no further from the passage mouth than the air inlet or inlets, and an air blast atomizer lip means within the mouth of the fuel/air passage operable to produce an atomised spray of fuel in the vicinity of the tip of the flame lighter from the fuel present in the fuel/air passage.

In the context of the claimed invention the term "flame lighter" is used to encompass both spark gap devices and surface discharge units well established in the art, and to encompass also any other form of device capable of providing sufficient transfer of heat to the fuel in the encompassing atomised spray to ignite the fuel.

Air blast atomizers are established in the art in the context of the main fuel atomizers for gas turbine engines. An air blast atomizer is one of a form such that the kinetic energy of an airflow at a high volume rate shatters fuel into atomised droplets without recourse to an atomizer nozzle. In the claimed invention a lip within the mouth of the fuel/air passage provides the means to air blast atomisation.

The torch igniter defined above has several features which contribute to an expectation of reliability and long life when used in the intended manner. The positioning of the fuel inlets with regard to the air inlets ensures that there is no space for fuel to reside in the device out of the influence of the air flow. The air blast atomizer configuration is a high volume air flow configuration which does not include a narrow exit passage. It is therefore less vulnerable to blockage than other types of atomizer and moreover it operates on and can be purged by compressor delivery air so avoiding the requirement for a separate supply of purging air at higher pressure. It is intended that the flow of air is maintained through the torch igniter throughout the operating cycle of the engine. The exit air flow from the mouth of the fuel/air passage shrouds the tip of the flame lighter in air which is cool in relation to the combustion gases within the combustion chamber and this serves to protect the flame lighter.

Preferably there are a plurality of air inlets and these are configured such that their discharge into the fuel/air passage is on a near tangential trajectory with respect to the cross-section of the fuel/air passage. This encourages a spiral air flow along the fuel/air passage around the flame igniter body with the fuel flowing as a film on the inner surface of the sleeve towards the air blast atomizer lip.

Preferably the torch igniter incorporates a secondary passage for the supply of air the torch igniter being configured such that this secondary passage opens as an annulus surrounding the mouth of the fuel/air passage and being configured such that the air blast atomizer lip is intermediate the air flow from the mouth of the fuel-/air passage and that from the exit annulus of the secondary passage.

These features assist the functioning of the air blast atomizer lip and help to provide good flow of well atomized fuel to the vicinity of the tip of the flame lighter. This tip is situated within an envelope of swirl stabilized re-circulatory air flow. The re-circulatory nature of this air flow tends to separate the smaller droplets of well atomised fuel from the larger droplets which are unable to accommodate the change of direction within the air flow and tend to follow a near-ballistic path clear of the flame lighter tip. This minimises any danger that the flame lighter might be flooded by poorly atomised fuel. Moreover as the flame lighter is within the envelope of the recirculating atomised fuel and is sited in the core of the spray there is no possibility that the spray will be separated from the flame lighter by peculiarities in local aerodynamics within the combustion chamber.

In its most preferred form, the claimed torch igniter in combination with the combustion chamber of a gas turbine engine form a functionally interdependent unit and one in which the boundary between igniter and combustion chamber is blurred. In a gas turbine engine combustion chamber there is a ready source of air suitable for use in providing the atomised spray of fuel in the torch igniter, from the flow of compressor delivery air in the space between the combustion chamber liner and the combustion chamber pressure casing. The claimed torch igniter has been devised to utilize this supply of air. However at fuel engine power this air is delivered from the compressor at a temperature of say 700° C. which could lead to cracking of any fuel which resides in the igniter on admixture therewith if not adequately pre-cooled. Specific provising for pre-cooling should this be required can be made by cooling the air from the compressor prior to its discharge into the fuel/air passage by heat exchange with the much colder air outside the pressure casing. The torch igniter may incorporate a conduit leading from the air space between the combustion chamber liner and its pressure casing to the air inlet or inlets of the fuel/air passage, which conduit is exposed to the air outside the pressure casing. As mentioned above the boundary between torch igniter and combustion chamber can become blurred. It is envisaged that the conduit could be structurally part of the combustion chamber mounting for the claimed torch igniter —as in the embodiment specifically described —or be a separate piece of structure which could be part of the torch igniter or merely an interconnecting pipe.

BRIEF DESCRIPTION OF THE DRAWINGS

An embodiment of the invention is described below with reference to the drawings, of which.

DETAILED DISCUSSION OF PREFERRED EMBODIMENTS

Figure 1:
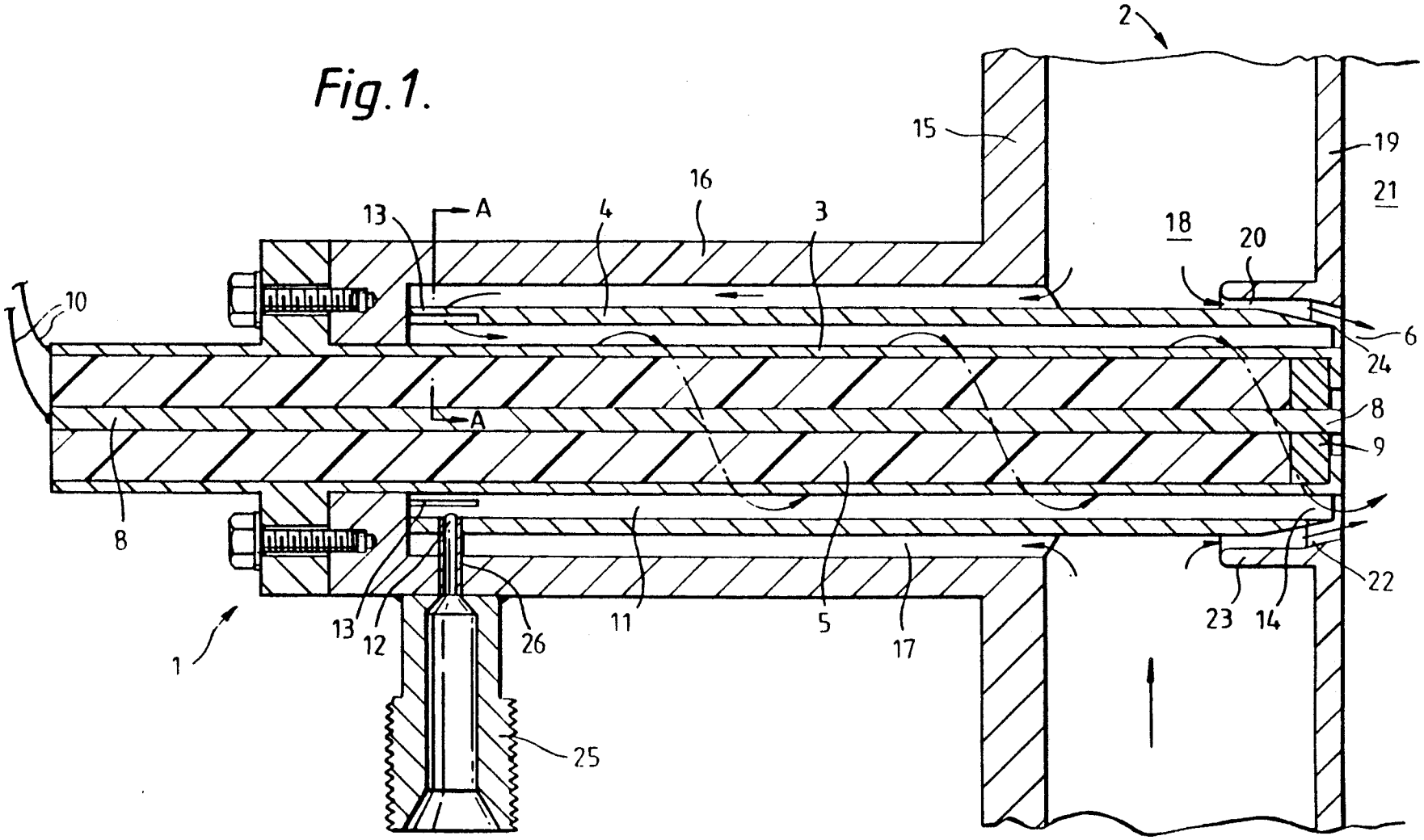
FIG. 1 schematic sectional drawing illustrative of the general configuration and functioning of the torch igniter rather than its structure.
Figures 2, 3:
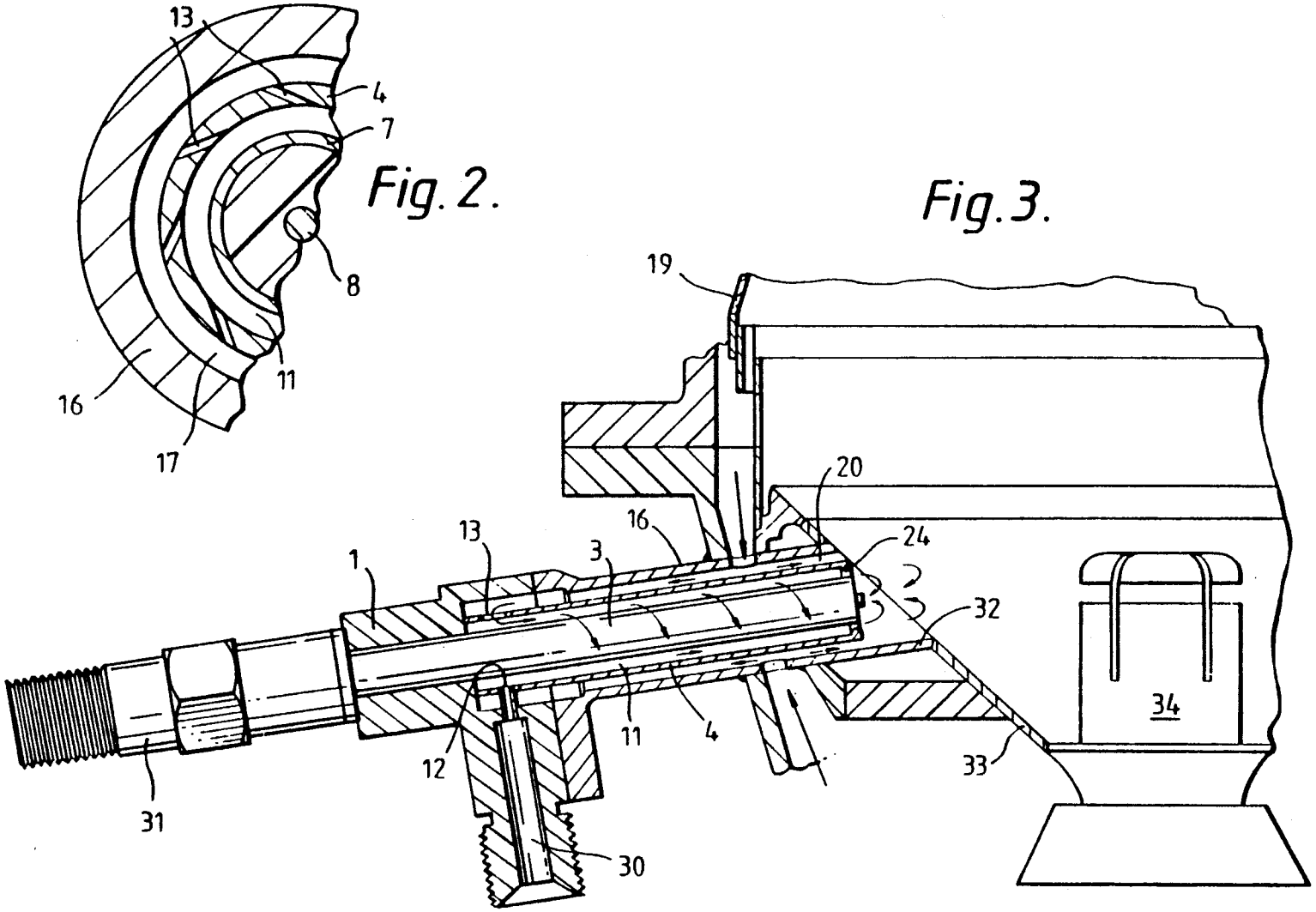
FIG. 2 is a partial cross section of FIG. 1 along the line AA.
FIG. 3 is a sectional drawing depicting one practical construction of the torch igniter.

The schematic drawings, FIGS. 1 and 2 are addressed first in this description. The configuration shown comprises a torch igniter generally designated 1 mounted on a combustion chamber 2 of the sort found in a gas turbine engine. This combustion chamber 2 can be any one of the three conventional types, i.e. separate combustor, tubo annular combustor or annular combustor. The torch igniter 1 comprises a flame lighter 3 mounted within a sleeve 4. The flame lighter 3 has a body portion 5 and a tip portion 6. The tip portion 6 includes electrodes 7 and 8 and between the electrodes a semi-conductive spacer 9. Electrode 7 is formed by the metallic case of the flame lighter 3 and electrode 8 extends through the centre of the flame lighter 3. At the end of the flame lighter 3 which is remote from its tip an electrical connection 10 is made to the electrodes 7 and 8. The sleeve 4 encircles the body portion 5 of the flame lighter 3 with an air space between the two. Sleeve 4 and the body portion 5 define in combination a passage 11 which is termed the fuel/air passage. A fuel inlet 12 and air inlets 13 discharge into the fuel/air passage 11 at the end of this passage which is remote from the tip 6 of the flame lighter 3. The fuel/air passage extends along the body 5 of flame lighter 3 to a mouth 14 surrounding the tip 6.

Around the torch igniter 1 the combustor 2 is of a form complementary to the torch igniter in structure and functioning. The normal pressure casing 15 of the combustion is formed into a conduit 16 within which the torch igniter 1 is located. This assembly is gas tight to the outside of the pressure casing 15. A passage 17 within the conduit 16 and defined by the conduit 16 and the sleeve 14 in combination leads from the air space 18 between the pressure casing 15 and the combustion chamber liner 19 to the air inlets 13. A secondary passage 20 leads from air space 18 to discharge within combustion space 21 via an annulus 22 which surrounds the mouth 14 of the fuel/air passage 11. Secondary passage 20 is defined by a portion 23 of the liner 19 in combination with that portion of sleeve 4 adjacent the mouth 14 of the fuel/air passage 11. The respective portion of sleeve 4 is chamfered on its outermost surface to a knife edge lip 24. A fuel connector 25 provides the interface between the torch igniter 1 and the external parts of the fuel supply system which are not shown. Connector 25 leads via a pipe 26 to the fuel inlet 12.

The operation of the torch igniter 1 described above is as follows. Air delivered by the engine compressor stage flows into the air space 18 and some portion of this total flow passes along passage 17 to the air inlets 13. These air inlets 13 are skewed slots (see FIG. 2) which impart a near tangential trajectory to the air discharged from them. This air discharged from air inlets 13 flows in a generally spiral fashion around the body 5 of the flame lighter 3 along the fuel/air passage 11 to the mouth 14 of that passage. This air flow is maintained for so long as the engine is turning and delivering air under pressure at the exit from the compressors stage. That part of the flow which takes place within conduit 16 along passage 17 enables heat transfer between the flowing air and the air outside the engine in the vicinity of the conduit. This pre-cools the compressor delivery air from a temperature of say 700° C. at which it is delivered in normal running of the engine to a temperature suitable for admixture with the torch igniter fuel avoiding cracking of that fuel say at 180° C. Compressor delivery air also flows from air space 18 along the secondary passage 20 to discharge at the exit annulus 22. All the above mentioned air flows are indicated in FIG. 1 by arrows.

When it is required to start the engine this is rotated by means of an external power supply to initiate the supply of compressor delivery air and the air flows described above. Simultaneously with this the electrical and fuel supplies to the torch igniter are established. Fuel discharges from the fuel inlet 12 into the fuel/air passage 11 and is carried along this passage, primarily as a film present on the inner surface of sleeve 4, under the impetus of the air flow along the passage. At the knife edge lip 24 the fuel film is stripped from the surface by the air flow along the fuel/air passage 11, and atomised to a high degree by interaction between the aforementioned air flow and that adjacent air flow from the discharge annulus 22 of the secondary passage 20. This spray of atomised fuel encircles the tip 6 of the flame lighter 3 and is carried towards the electrodes 7 and 8 by the recirculation within the discharged air flow produced by the discharge configuration.

The flame igniter 1 is a conventional device of the surface discharge tyupe. A high voltage is applied between the ground electrode 7 and the central electrode 8. This leads to a leakage current between electrodes across the surface of the semi-conductive spacer 9 which in turn leads to ionization in the air space between the electrodes and an arc discharge. This arc discharge is not continuous but repetitive being triggered by pulsed application of high voltage to the connections 10. The arc discharge transfers sufficient heat energy to the surrounding envelope of fuel ladened air to ignite the fuel and this in turn leads to ignition of the fuel from the main combustion spray.

Once the main combustion spray is alight the fuel supply to the torch igniter 1 is shut off. Fuel remaining in the fuel/air passage 11 is purged from the torch igniter 1 by the continuing through flow of air. This through flow of air is maintained during operation of the engine and serves to shield the flame lighter tip 6 from the heat of the combustion within the combustion chamber.

The description below addresses FIG. 3 which depicts a practical embodiment of a torch igniter largely similar in function and layout to that described above. The same references are retained in this figure for those parts which are functionally identical to those described with reference to the previous figures. The torch igniter 1 is made in the form of a plug which is fitted into a protruding boss located on the pressure casing of the combustor. The plug incorporates sleeve 4 and flame lighter 3. A fuel connector is shown at 30 this connecting to the fuel inlet 12. An electrical connector is shown at 31. The protruding boss functions as conduit 16 and is indicated with this reference. The secondary passage 20 is defined by a tube 32, attached to the combustion liner 19, in combination with the sleeve 4 of the flame lighter 3. At its distal end, the sleeve 4 is not tapered to a knife edge lip as shown in FIG. 1, but has an inwardly directed annular proturberence which serves as the atomizer lip 24. The torch igniter 1 is located in the head wall region 33 of the combustion chamber flame liner 19. A main fuel source of the vaporizing type is indicated at 34. The torch igniter is suitably located in this headwall region 33 to intercept a portion of the fuel flow from the vapourizer 34. Air flows and air/fuel flows are again indicated by arrows. Operation of this torch igniter is exactly as described previously.

What is claimed:

1. A torch igniter for a gas turbine engine, said engine including a means for supplying compressor bleed air, said igniter comprising:

a flame lighter having a tip section and an electrical spark producing electrode at said tip section and an elongate body;

a sleeve present around the body of the flame lighter and spaced therefrom so as to define therebetween a fuel/air passage, the sleeve being configured such that said passage, opens at a mouth portion around the tip section of the flame lighter, at least one air inlet which discharges said bleed air into the fuel/air passage at a position spaced from the passage mouth, at least one fuel inlet which discharges into the fuel/air passage at a position therein which is spaced from the passage mouth but is no further from the passage mouth than said at least one air inlet, an air blast atomizer lip means, within the mouth of the fuel/air passage operable, for produceing an atomised spray of fuel in the vicinity of the tip section of the flame lighter from the fuel present in the fuel/air passage; and a conduit, supplied with said bleed air, into which said sleeve is located, said conduit and sleeve forming a cooling passageway for at least partial flow of said bleed air through said passageway and into said air inlet.

2. A torch igniter as claimed in claim 1 in which there are a plurality of said air inlets and in which these are configured such that their discharge of said compressor bleed air into the fuel/air passage is on a near tangential trajectory with respect to a circular cross section of the fuel/air passage.

3. A torch igniter as claimed in claim 1 wherein said conduit and said sleeve in combination comprises a secondary passage for the supply of bleed air, the torch igniter being configured such that this secondary passage opens as an annulus surrounding the mouth of the fuel/air passage and being configured such that the air blast atomizer lip is intermediate the air flow from the mouth of the fuel/air passage and that from the exit annulus of the secondary passage.

4. A torch igniter as claimed in claim 1, wherein said gas turbine engine includes a combustion chamber liner, wherein said conduit leads from an air space between the combustion chamber liner and a pressure casing to said at least one air inlet of the fuel/air passage, wherein said conduit is exposed to the air outside the pressure casing.

5. A torch igniter as claimed in claim 4 in which said conduit envelopes at least a portion of the sleeve.

6. In a liquid fueled gas turbine engine, including at least one combustion chamber consisting of a flame casing, a pressure casing encompassing said flame casing in a spaced apart relationship therewith and defining therebetween an air passage, means for supplying compressor bleed air to said air passage, said pressure casing being situated in said engine such that at least a part of its surface abuts a bypass duct and is exposed to cool air in said bypass duct, an improved torch igniter comprising:

a flame lighter comprising an elongate body with an electrical ignition source at a tip section of said flame lighter;

a sleeve, with said flame lighter located within said sleeve, defining a fuel/air passage around said elongate body, and having a discharge port within which said electrical ignition source is located;

at least one air inlet port within said sleeve at a position remote from said discharge port;

at least one fuel inlet port within said sleeve at a position remote from said discharge port but no further from the discharge port than said at least one air inlet port;

an air blast atomizer lip means within said fuel/air passage located adjacent to said discharge port; and a conduit, leading from said pressure casing through said bypass duct thence to said sleeve, wherein compressor bleed air from said air passage is directed through the conduit to discharge into said fuel/air passage via said at least one air inlet, wherein at least a portion of said conduit is exposed to and in a heat exchange relationship with said cool air.

7. An improved igniter as claimed in claim 6 in which said conduit is concentric with and encompasses at least an end of said sleeve.

8. An improved igniter as claimed in claim 6 further including a secondary passage from said air passage to said discharge port of said fuel/air passage, and in which said air blast atomizer lip means is a chamfer at the discharge port end of said sleeve.

9. In a liquid fueled gas turbine engine, including at least one combustion chamber consisting of a flame casing, a pressure casing encompassing said flame casing in a spaced apart relationship therewith and defining therebetween an air passage, and a means for supplying compressor bleed air to said passage, said pressure casing being situated in said engine such that at least a part of its surface abuts a bypass duct and is exposed to cool air in said bypass duct, an improved torch igniter comprising:

a flame lighter comprising an cylindrical body with an electrical ignition source at a tip section thereof;

a sleeve concentrically mounted with said cylindrical body and encompassing at least a portion of said cylindrical body, one end of said sleeve penetrating the wall of said flame casing but not extending beyond the internal surface of said wall and being open ended to define a fuel/air discharge port within which said tip section of the ignition source is located;

at least one air inlet port within said sleeve at the end thereof distant from the flame casing;

a tube concentrically mounted with said sleeve and encompassing at least a portion of said sleeve intermediate said flame casing and said distant end, defining in combination with said cylindrical body a conduit leading from said air passage to said at least one air inlet, said tube being exposed in a heat exchange relationship to said cool air in said bypass duct;

at least one fuel inlet port within said sleeve distant from said discharge port but no further from said discharg port than said at least one air inlet port;

a second tube concentrically mounted with said sleeve and encompassing at least a portion of said sleeve at the fuel/air discharge port end, said second tube penetrating said flame casing but not extending beyond an internal surface of said flame casing, said second tube and said cylindrical body defining in combination a secondary passage leading from said air space to an auxiliary discharge port surrounding said fuel/air discharge port; and a chamfered lip end to said second tube at the discharge port end of said second tube, comprising in combination with said fuel/air port and said auxiliary discharge port, an air blast atomizer.

* * * * *